US011136212B2

(12) United States Patent
Connors et al.

(10) Patent No.: US 11,136,212 B2
(45) Date of Patent: Oct. 5, 2021

(54) SYSTEM AND METHOD FOR HEAT ASSISTED SADDLE FINISHER FOLDING

(71) Applicant: Toshiba TEC Kabushiki Kaisha, Shinagawa-ku (JP)

(72) Inventors: William M. Connors, Lexington, KY (US); Michael W. Lawrence, Lexington, KY (US); Brad W. Towe, Versailles, KY (US)

(73) Assignee: Toshiba TEC Kabushiki Kaisha, Shinagawa-ku (JP)

( * ) Notice: Subject to any disclaimer, the term of this patent is extended or adjusted under 35 U.S.C. 154(b) by 0 days.

(21) Appl. No.: 16/803,316

(22) Filed: Feb. 27, 2020

(65) Prior Publication Data

US 2021/0269274 A1 Sep. 2, 2021

(51) Int. Cl.

| | |
|---|---|
| ***B65H 45/30*** | (2006.01) |
| ***B42C 9/00*** | (2006.01) |
| ***B42C 1/12*** | (2006.01) |

(52) U.S. Cl.

CPC ..... *B65H 45/30* (2013.01); *B42C 1/12* (2013.01); *B42C 9/0093* (2013.01)

(58) Field of Classification Search

CPC ..... B42C 1/12; B42C 9/0093; B41L 43/06; B65H 45/12; B65H 45/30; B65H 37/06; B65H 2301/43822; B65H 2301/45

USPC ..... 270/37; 493/442

See application file for complete search history.

(56) References Cited

U.S. PATENT DOCUMENTS

| | | | | |
|---|---|---|---|---|
| 5,558,925 | A * | 9/1996 | Fritzman | B31D 3/002 156/107 |
| 6,419,616 | B1 * | 7/2002 | Campbell | B31D 1/022 493/10 |
| 6,562,171 | B1 * | 5/2003 | Archie, Jr. | B42D 1/08 156/204 |
| 6,589,000 | B1 * | 7/2003 | Boss | B42C 9/0093 412/18 |
| 7,503,554 | B2 * | 3/2009 | Trovinger | B65H 37/04 270/52.18 |

* cited by examiner

*Primary Examiner* — Leslie A Nicholson, III

(74) *Attorney, Agent, or Firm* — Ulmer & Berne LLP

(57) ABSTRACT

A system and method for assembling booklets in document finishers such as saddle staplers includes first and second opposed rollers configured to receive an edge of a stapled crease of a stack of printed documents. The rollers apply both heat and pressure to the crease to form a tight fold. A second set of rollers provides further heat and pressure to the fold to increase tightness even further. Pressure and temperature of one or both roller sets is controllable to accommodate paper stacks having different numbers of pages or different paper characteristics.

18 Claims, 8 Drawing Sheets

SYSTEM AND METHOD FOR HEAT ASSISTED SADDLE FINISHER FOLDING

TECHNICAL FIELD

This application relates generally to printing of books or booklets by use of a saddle finisher. The application relates more particularly to improving folding by applying heat to the folding mechanism during a folding operation.

BACKGROUND

Document processing devices include printers, copiers, scanners and e-mail gateways. More recently, devices employing two or more of these functions are found in office environments. These devices are referred to as multifunction peripherals (MFPs) or multifunction devices (MFDs). As used herein, MFPs are understood to comprise printers, alone or in combination with other of the afore-noted functions. It is further understood that any suitable document processing device can be used.

MFPs may be fitted with document finishers which provide functions such as collating, hole punching or stapling. A finisher may be integrated into an MFP, or may be offered as an accessory to be fitted onto an MFP. Finishers may include automated formation of booklets. This can be accomplished by specialized N-up printing referred to as saddle stitching, so named because collated sheets were draped over a saddle-like apparatus during the stapling/stitching process. In saddle stitching, folded sheets are gathered together, one inside the other, and then stapled through the fold line with wire staples. The staples pass through the folded crease from the outside and are clinched between the centermost pages. Two staples are commonly used but larger books may require more staples along the spine. Saddle stitches are formed with groups of four images oriented on each printed sheet, two images on a frontside and two images on a backside. The print images are sequenced such that pages appear in a desired order when a booklet has been formed by stapling and folding. With this process, booklet pages are one half the size of paper stock used. In the United States, use of 8½"×17" sheets results in a 8½"×11" booklet. With sizing done in ISO 216, an A3 sized paper (420 mm×297 mm) results in an A4 (210 mm×297 mm) booklet.

The saddle stitch method is most effective for binding booklets and publications with around 64 pages or less. Books with more pages may become bulky when folded and may not lie as flat as desired when saddle stitched.

BRIEF DESCRIPTION OF THE DRAWINGS

Various embodiments will become better understood with regard to the following description, appended claims and accompanying drawings wherein:

DETAILED DESCRIPTION

The systems and methods disclosed herein are described in detail by way of examples and with reference to the figures. It will be appreciated that modifications to disclosed and described examples, arrangements, configurations, components, elements, apparatuses, devices methods, systems, etc. can suitably be made and may be desired for a specific application. In this disclosure, any identification of specific techniques, arrangements, etc. are either related to a specific example presented or are merely a general description of such a technique, arrangement, etc. Identifications of specific details or examples are not intended to be, and should not be, construed as mandatory or limiting unless specifically designated as such.

With saddle staplers, a fold crease can be too rounded, particularly with larger numbers of pages or thicker paper stock. A sharper crease is desirable because it creates a more aesthetic and functional booklet that can be stacked with less accumulated volume. Saddle staple finishers staple sheets, typically twice, in line with a direction in which paper will be folded in half to create a booklet. The stack of paper is then folded and ejected into an accumulation tray. Example embodiments herein add heat to fold rollers to "set" the fold into the paper, potentially eliminating a need for secondary or enhancement rollers. For embodiments that retain enhancement rollers, enhancement rollers can also be heated to make them more effective and to allow more pages to be folded. Application of heat may be selectively made to the primary and if necessary, secondary or enhancement fold rollers.

Figure 1:
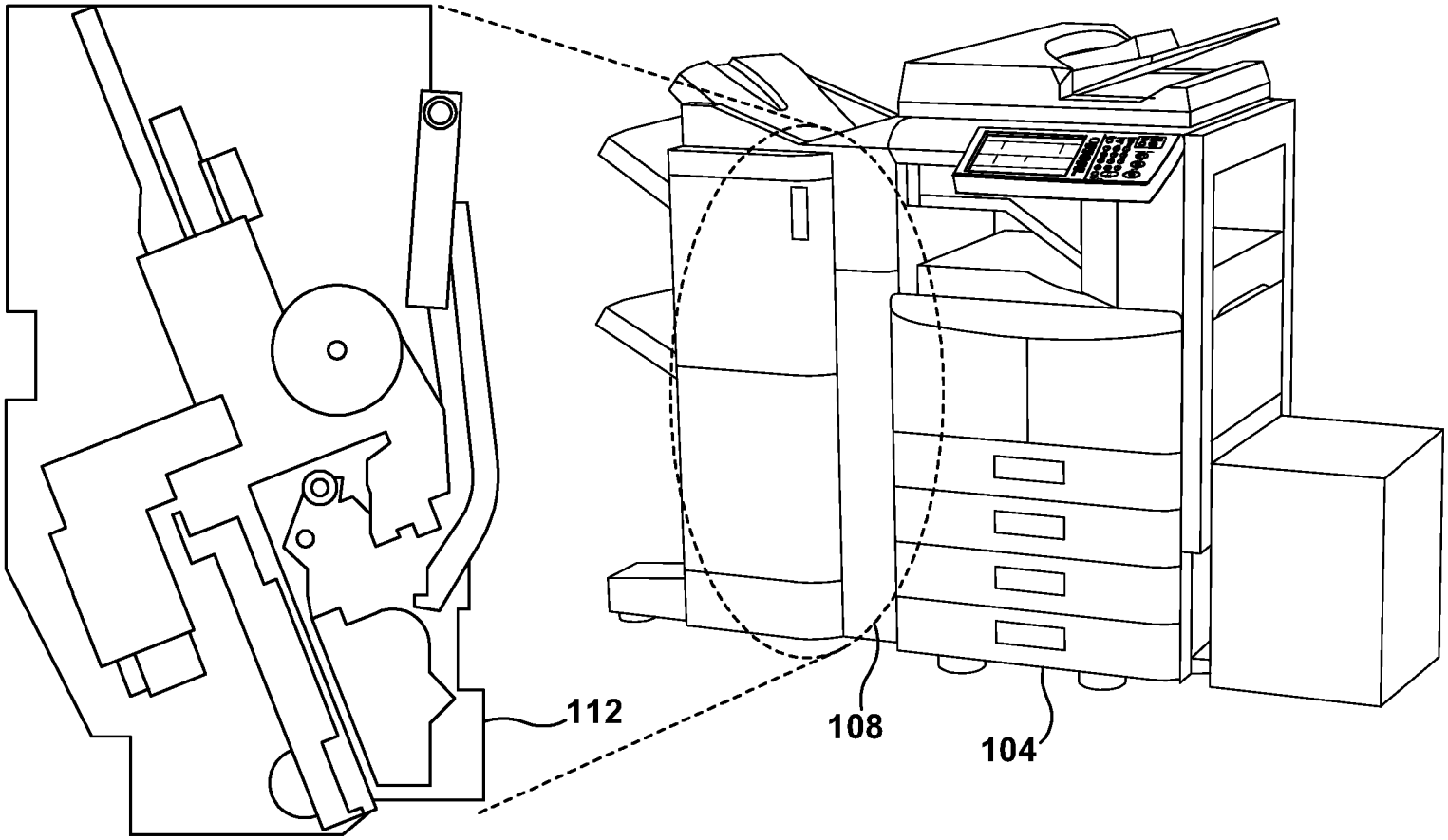
FIG. 1 is an example embodiment of a multifunction peripheral which has been fitted with a finisher.

In accordance with the subject application, FIG. 1 illustrates an example embodiment of a multifunction peripheral 104 which has been fitted with a finisher 108. Finisher 108 includes a finishing unit 112 that performs functions such as collating, stapling, hole punching or saddle stitching. By way of example, a suitable finisher is available Saddle Stitch Finisher Model No. MJ-6105 available from Toshiba TEC.

Figure 2:
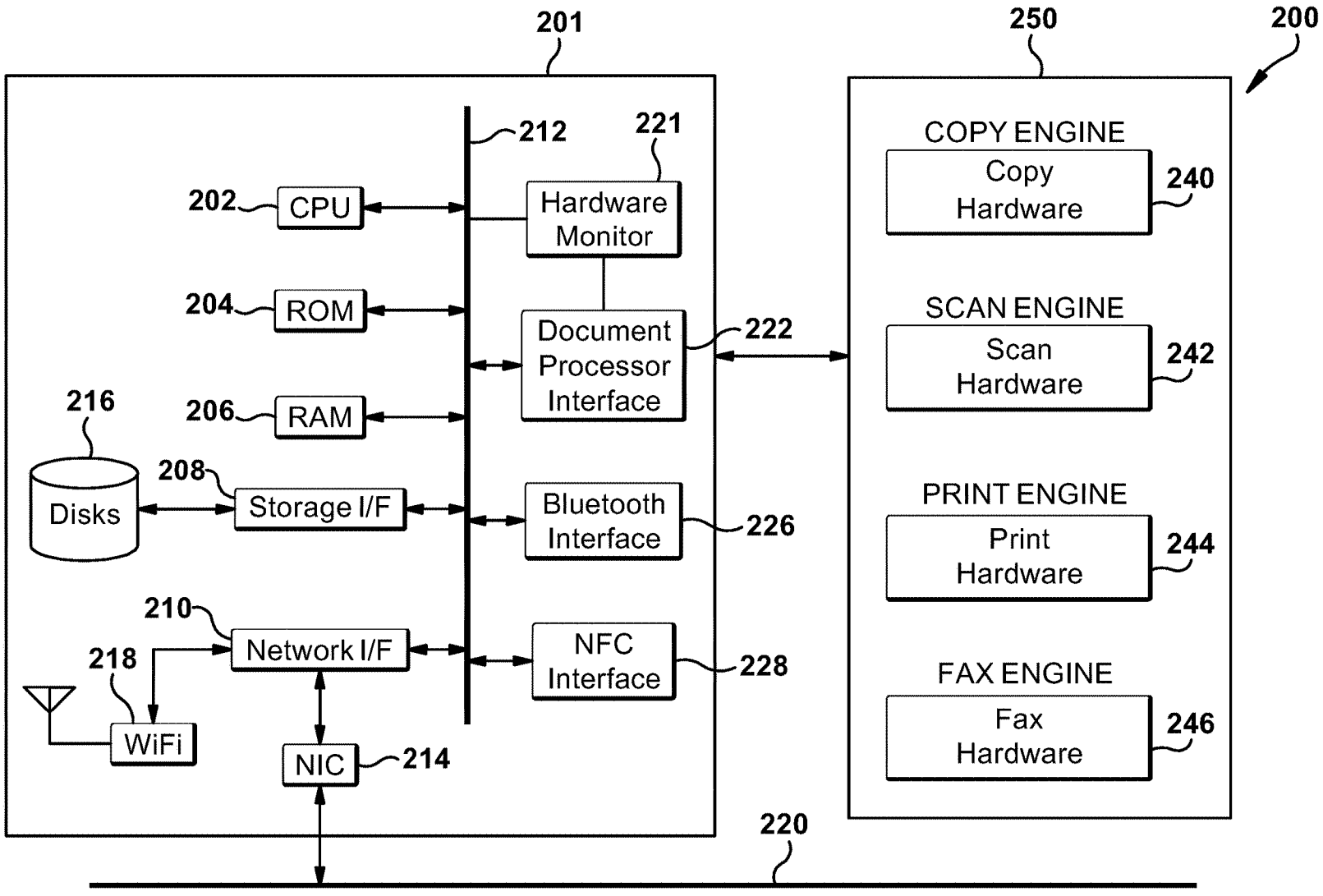
FIG. 2 is an example embodiment of a networked digital device comprised of document rendering system such as a multifunction peripheral.

Turning now to FIG. 2 illustrated is an example embodiment of a networked digital device comprised of document rendering system 200 suitably comprised within an MFP, such as with MFP 104 of FIG. 1. It will be appreciated that an MFP includes an intelligent controller 201 which is itself a computer system. Included in controller 201 are one or more processors, such as that illustrated by processor 202. Each processor is suitably associated with non-volatile memory, such as read only memory (ROM) 204, and random access memory (RAM) 206, via a data bus 212.

Processor 202 is also in data communication with a storage interface 208 for reading or writing data with storage 216, suitably comprised of a hard disk, optical disk, solid-state disk, cloud-based storage, or any other suitable data storage as will be appreciated by one of ordinary skill in the art.

Processor 202 is also in data communication with a network interface 210 which provides an interface to a network interface controller (NIC) 214, which in turn provides a data path to any suitable wired or physical network connection 220, or to a wireless data connection via a wireless network interface, such as WiFi 218. Example wireless connections include cellular, Wi-Fi, wireless universal serial bus (wireless USB), satellite, and the like. Example wired interfaces include Ethernet, USB, IEEE 1394 (FireWire), Lightning, telephone line, or the like. Processor 202 is also in data communication with a hardware monitor 221, suitably amassing state data from subassemblies, sensors, digital thermometers, or the like, and suitably including digital state date including device codes, such as device error codes. Processor 202 can also be in data communication a document processor interface 222, with Bluetooth interface 226 and NFC interface 228 via data path 212.

Processor 202 can also be in data communication with any suitable user input/output (I/O) interface (not shown) which provides data communication with user peripherals, such as displays, keyboards, mice, track balls, touch screens, or the like.

Document processor interface 222 is suitable for data communication with MFP functional units 250. In the illustrate example, these units include a copy engine, suitably comprised of copy hardware 240, a scan engine, suitably comprised of scan hardware 242, a print engine, suitably comprised of print hardware 244 and a fax engine, suitably comprised of fax hardware 246. These subsystems together comprise MFP functional hardware 250. It will be understood that functional units are suitably comprised of intelligent units, including any suitable hardware or software platform.

Figure 3:
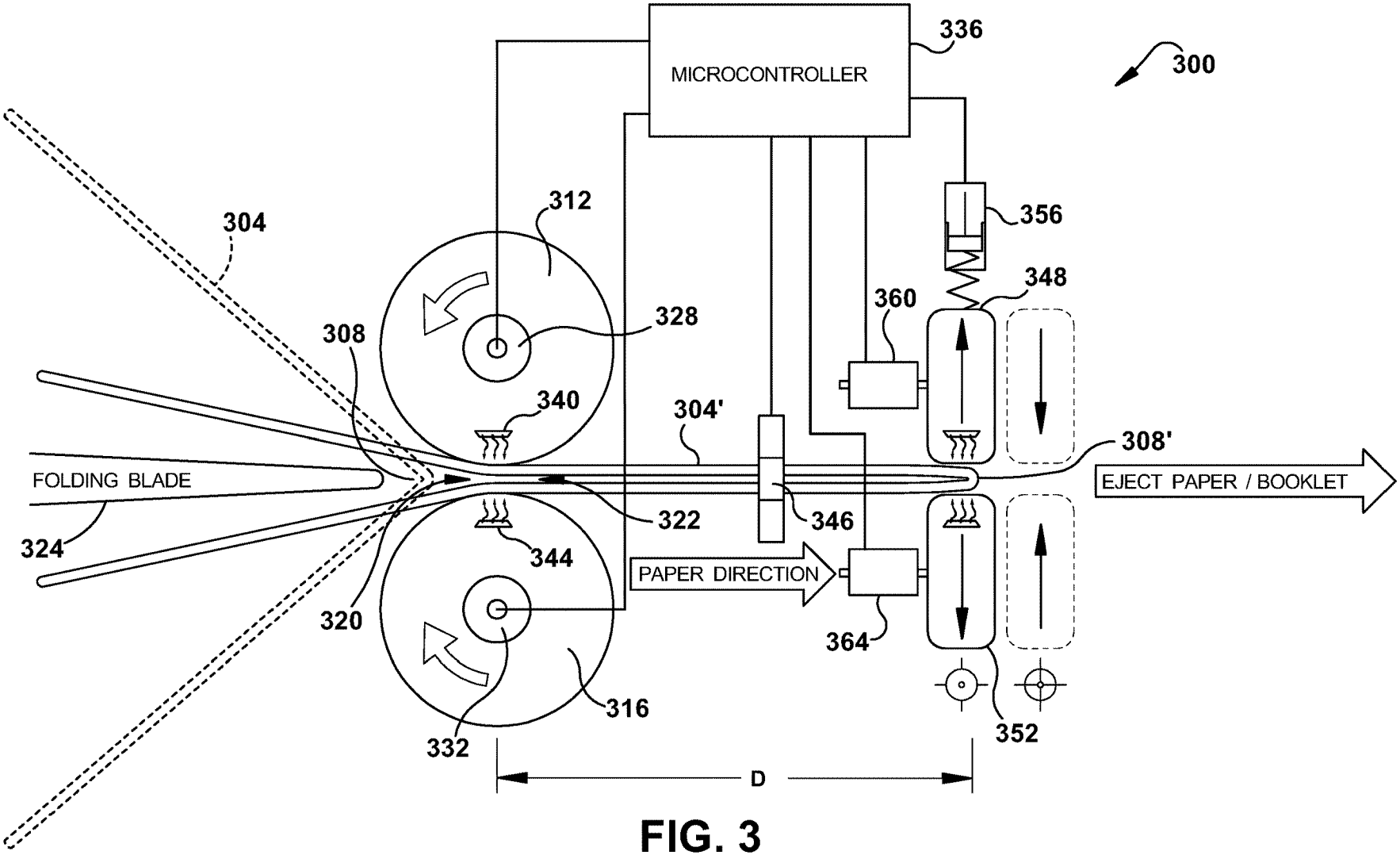
FIG. 3 is a first example embodiment of a booklet folding system.

FIG. 3 is a functional diagram of an example embodiment of a booklet folding system 300, suitably used in connection with saddle stitching operation in a document finisher. As noted above, saddle stitching may not be usable for documents with large numbers of pages, with a typical limit being 64 pages. With larger booklets, the booklets tend to bow at the fold, preventing the booklet from being as flat would otherwise be desired. In accordance with the example embodiment of FIG. 3, heat is applied to a booklet as it is folded to allow for a flattened fold area with a greater number of pages or with the use of heavier stock paper. Folding is suitably comprised of first and second fold operations using rollers that travel in different directions relative to a booklet fold area. In the example, paper is received at 304, which paper includes a crease 308 on a centerline thereof. One or more staples has suitably been applied at crease 308. Paper 304 is comprised of two or more sheets forming a booklet. The paper 304 is fed, leading with the fold, to counter-rotating rollers 312 and 316 at a nip 320. When the paper fold encounters the nip 320, the booklet is drawn between the rollers 312, 316 and resultant pressure between the rollers 312, 316 cause crease 308 to become a fold where halves of the booklet touch on a center page. Crease 308 is suitably directed to nip 320 by folding blade 324 which extends along an interior of crease 308. Folding blade 324 may be retracted once the crease 308 is grabbed by the rollers 312, 316. Alternatively, the folding blade 324 may extend into the nip 320 prior to retraction. Paper 304' is then folded as it exits the rollers 312, 316 at exit nip 322. Rollers 312 and 316 are powered by any suitable motor or combination of motors, such as motor drives 328 and 332. Control of roller operation is suitably accomplished by microcontroller 336.

In the example embodiment of FIG. 3, rollers 312 and 316 are further provided with heating mechanisms 340 and 344, respectively. Any suitable resistive, inductive or radiant heating may be used, a particular example of which will be described below. Use of heat allows for softening of paper fibers for forming, with the tighter fold remaining once the paper cooled, analogously to ironing of clothing. An optimal temperature is contingent on several factors, including a number of folded sheets, paper thickness and roller rotational rate. Slower rotation will cause added heat buildup over time, and higher temperatures may scorch the paper. Higher roller temperature may be used when faster roller rotation is used. Additionally, folds are suitably subject to pressure during rolling which will also affect desirable roller temperatures. Particular choices of pressure, temperature and roller speed are therefore application specific.

A position of paper 304' is suitably controlled and determined by use of stepper motors that are positioned by microcontroller 336. Alternatively, paper position may be accomplished by any suitable sensor, such as via sensor 346. Fold edge 308' is moved toward another pair of rollers 348 and 352, which rollers are oriented so as to roll at a 90 degree angle relative to rollers 312 and 316. Rollers 348 and 352 are suitably separated from one another or contacting one another with a relatively low pressure, such as by control of piston or solenoid, illustrated as piston 356, until such point as fold edge 308' is disposed between them. Pressure is suitably controlled by microcontroller 336, with an eccentric bearing or cam as will be detailed further below. At that point, pressure is applied by piston 356, and the roller pair 348, 352 runs along fold edge 308' for further, enhanced fold compression. Rollers 348 and 352 are also suitably provided with heaters to further increase effectiveness of the secondary fold. With such secondary folding, paper fibers with diffing alignment within paper are subject to heat and pressure in multiple orientations for a more effective fold. In a particular example embodiment, initial loading pressure between the secondary rollers is suitably equivalent to the weight of 1,362 grams (approximately 3 lbs. or 13.3 Newtons). Enhanced pressure during a fold is suitably equivalent to an added force of the equivalent weight of an added 536 grams (approximately 1.2 lbs. or 5.2 Newtons), for a total force of approximately 4.2 lbs. or 18.6 Newtons. Rollers 348 and 352 are suitably driven by one or more motors, such as motors 360 and 364, suitably stepper motors under control of microcontroller 336. Once a booklet has been fully folded, it is suitably ejected.

Figure 4:
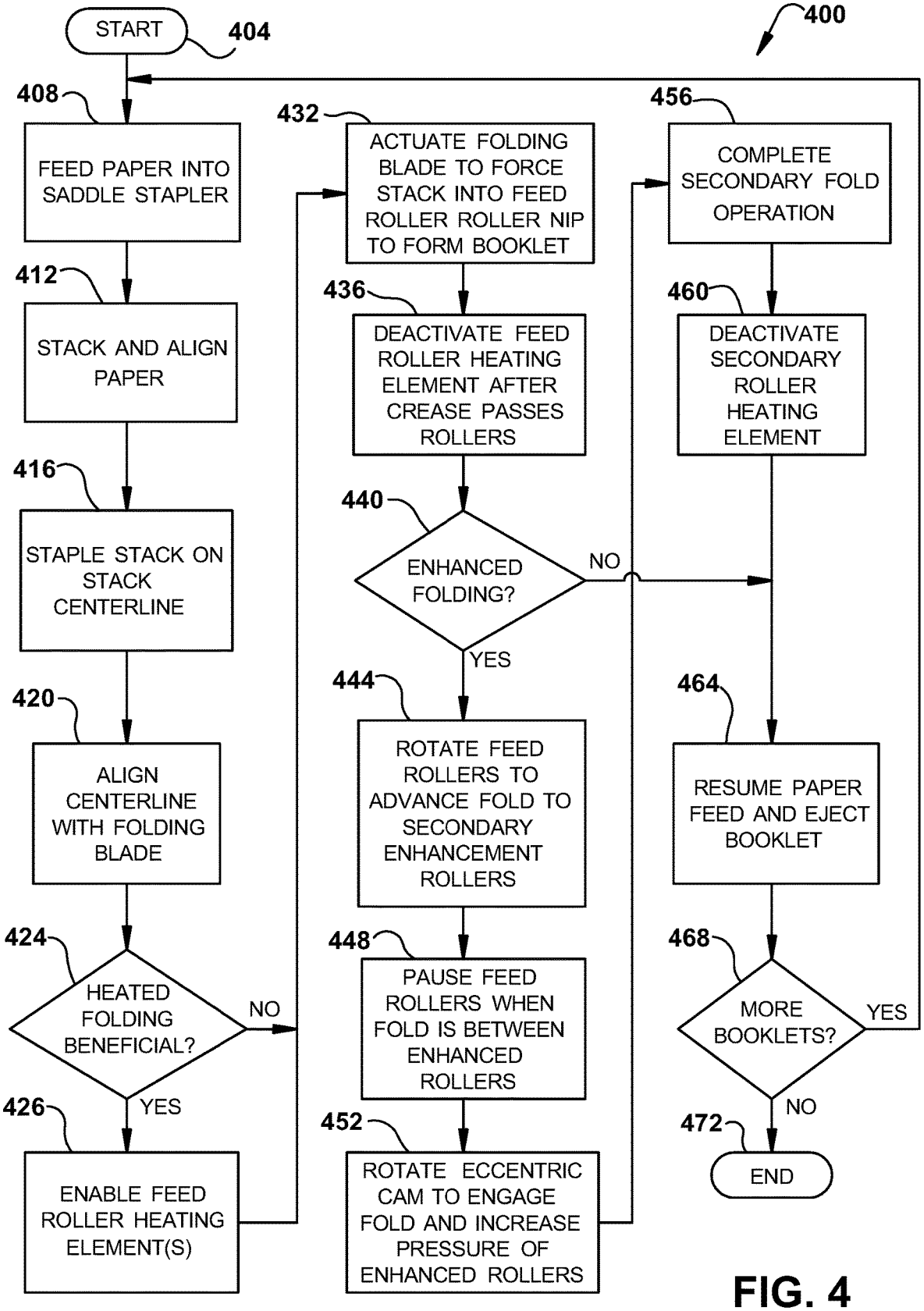
FIG. 4 is an example embodiment of an enhanced saddle stitch booklet folding.

FIG. 4 is a flowchart 400 of an example embodiment of an enhanced saddle stitch booklet folding suitably including two temperature enhanced seam rolling operations. The process commences at block 404 and proceeds to block 408 where paper, suitably comprised of two or more sheets, is fed into a saddle stapler. Paper is stacked and aligned at block 412 and stapled along a centerline at block 416. The centerline is aligned with a folding blade at block 420. A determination is made at block 424 as to whether heat enhanced rolling is beneficial for the paper. If so, roller heat to primary and secondary rollers is enabled at block 426. If heating is not beneficial, or once roller heating is enabled, the process proceeds to block 432 where the folding blade is actuated, forming a crease along the paper stapled centerline, and urging the crease into a nip of the primary rollers. Once the fold passes through the rollers, the heat element on the primary rollers is, if engaged, suitably deactivated at block 436 as being unnecessary, thus saving energy and avoiding risk possible damage or discoloration to the outside sheet forming the booklet cover.

Next a determination is made at block 440 as to whether enhanced folding with secondary rollers is desired. If so, the primary, feed rollers are rotated to advance the paper such that the fold is between secondary rollers for enhanced folding at block 444. The paper feed is paused at block 448 and a force is applied against the fold between the secondary rollers at block 452. This is suitably done by a piston, cam or solenoid as noted above. A secondary fold operation is completed at block 456 and heat, if engaged, is disengaged at block 460. The completed booklet is ejected at block 464. If no enhanced folding is selected at block 440, the process proceeds directly to block 464. If it is determined at block 468 that another booklet is be formed, the process returns to block 404. If not, the process ends at block 472. It is to be appreciated that the example embodiment of FIG. 4 provides a configurable folding system that allows for one or two folding operations, with heat enhancement to one or both. Thus, a wide variety of paper stack sizes and paper properties can be accommodated. Thin booklets may be acceptable with a single, no heat rolling operation. Thick booklets or booklets with thicker paper stock may be best created with two, heated folding operations. Other combinations of stack thickness or paper properties engage fold options accordingly. Thus, speed and energy consumption are suitably balanced with booklet quality.

Figure 5:
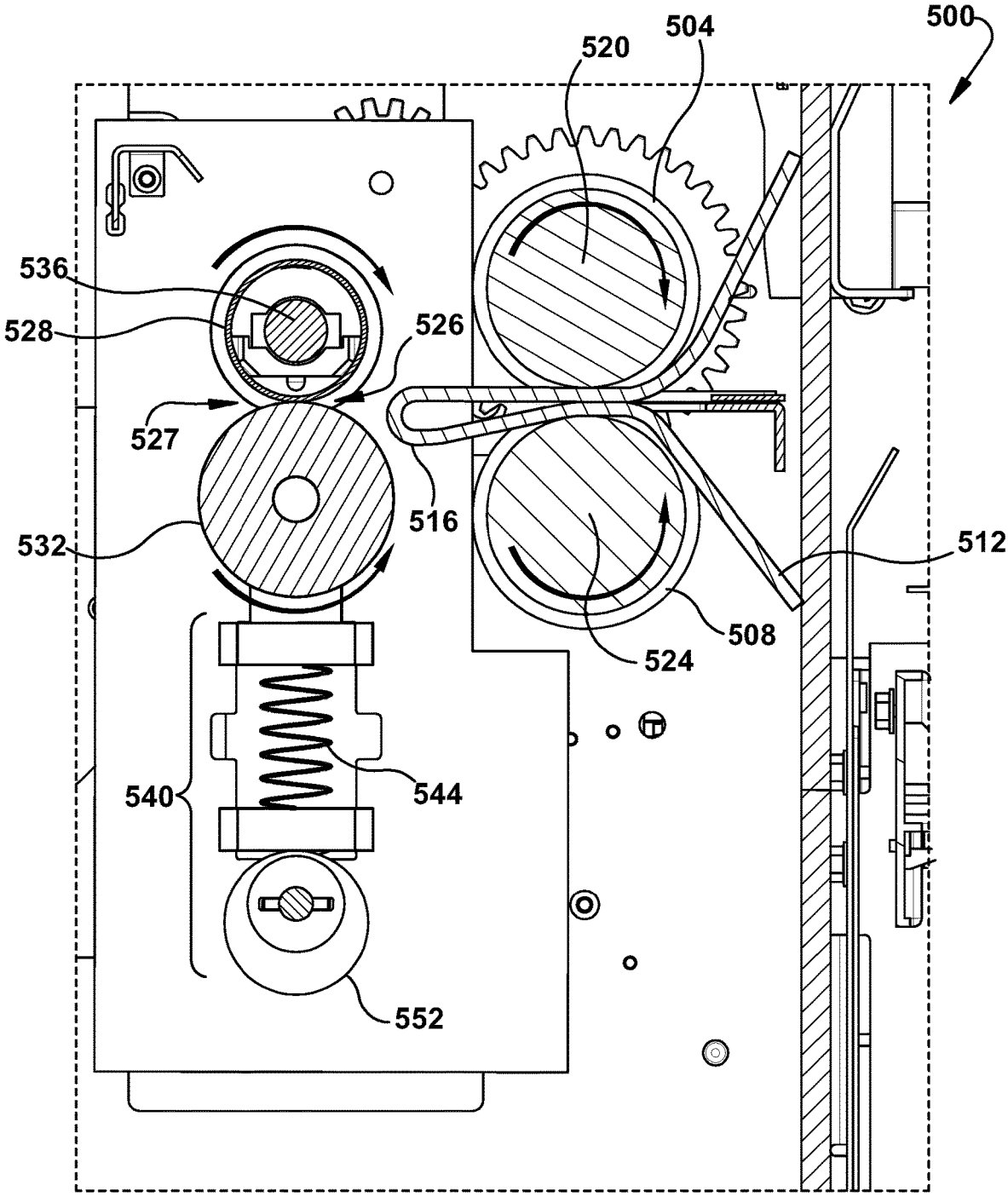
FIG. 5 is a second example embodiment of a booklet folding system.
Figure 6:
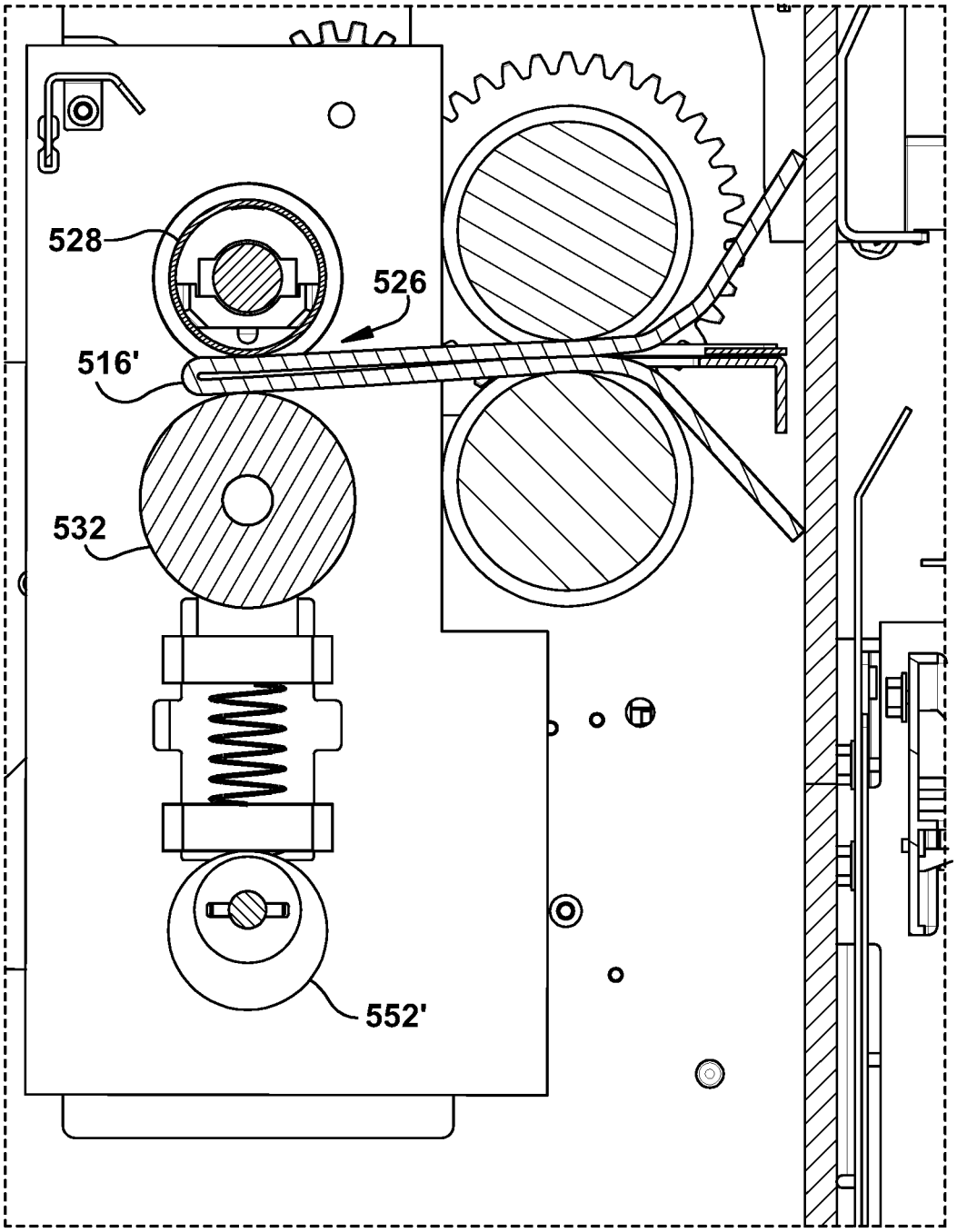
FIG. 6 is an a further rendering of the example embodiment of FIG. 5.
Figure 7:
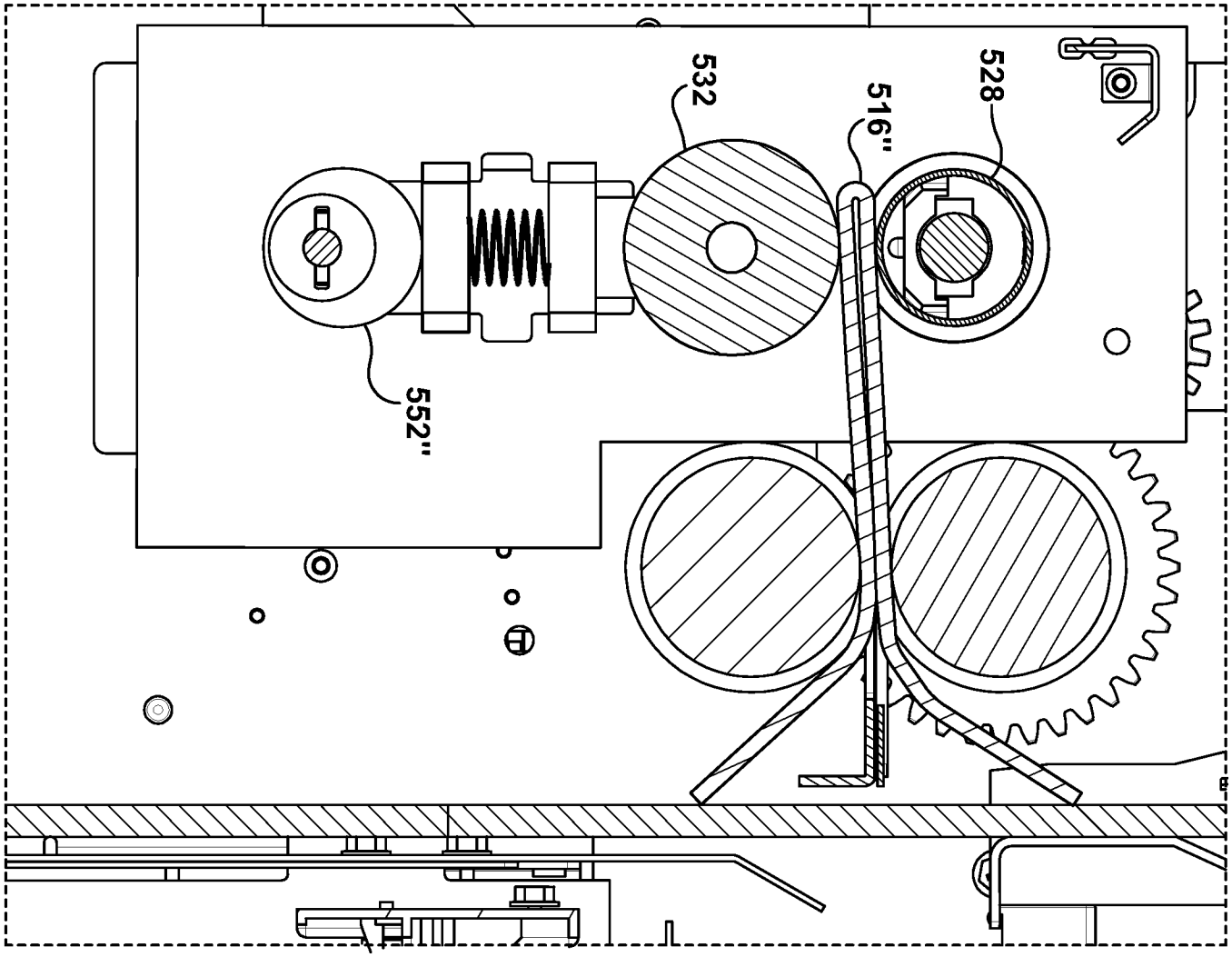
FIG. 7 is a further rendering of the example embodiment of FIGS. 5 and 6.

FIG. 5 illustrates an example embodiment of a booklet folding system 500. Included are counter-rotating primary rollers 504 and 508 which receive paper 512 into a nip and form fold 516. Rollers 504 and 508 include heating elements 520 and 524, respectively. Fold 516 is urged by rollers 504 and 508 to nip 526 formed between counter-rotating secondary rollers 528 and 532, and exits the rollers 504 and 508 at exit nip 527. Roller 528 is fixedly mounted on its axis for rotational movement includes integrated heating element 536. Roller 532 is moveable relative to roller 528, applying pressure to roller 528 in accordance with a biasing mechanism 540. Biasing mechanism 540 is comprised of one or more axially aligned springs, such as spring 544 directed radially inward to an axis of roller 532. Pressure between rollers 528 and 532 is a function of the spring constant and compression distance and is set at first pressure level when cam 552 is rotated to a first position, and a second pressure level when rotated to a second position, example first and second positions being illustrated in FIGS. 6 and 7. With added reference to FIGS. 6 and 7, it will be seen that the system suitably employs less pressure between rollers 528 and 532 as fold 516' engages nip 526 as illustrated by a position of cam 552' of FIG. 6, and more pressure once the fold 516" is disposed between the rollers 528 and 532 illustrated by position of cam 552" of FIG. 7. Pressure is suitably lessened by again rotating cam 552 once the fold 516 has passed thorough the secondary rollers 528 and 532. It is be noted that, in the illustrated example, all rollers are aligned with parallel axes.

Figure 8:
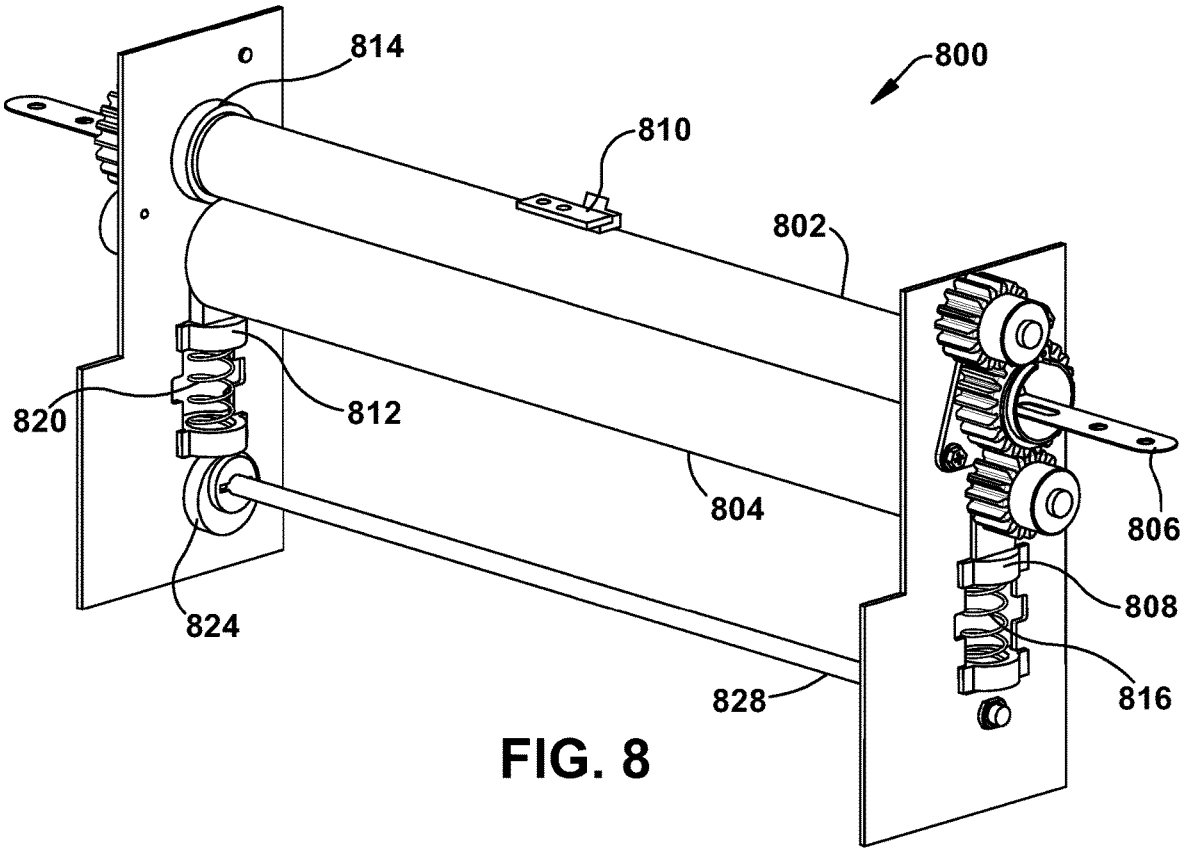
FIG. 8 is an example embodiment of a secondary roller system.

FIG. 8 illustrates an example embodiment of a secondary roller system 800 that employs counter-rotating rollers 802 and 804. In the example, roller 802 is comprised of a heat conductive material, such as ceramic or metal. By way of particular example, roller 802 is comprised of aluminum having about a 1 mm wall thickness. Roller 802 includes an integrated heating element 806, and a thermistor 810 which cooperate to set a surface temperature of roller 802 at a desired temperature. Roller 802 is suitably supported by one or more high temperature bearings, such as bearing 814. Roller 804 is illustrated as an idler roller, suitably comprised of a compressible surface, such as silicone rubber. Roller 804 is supported by floating bearings 808 and 812, which are biased by springs 816 and 820, respectively. Compression of springs 816 and 820 is controlled by a rotational positon of a first eccentric bearing 824 secured on an opposed distal end of shaft 828 to a second eccentric bearing (not shown) associated with spring 816.

Figure 9:
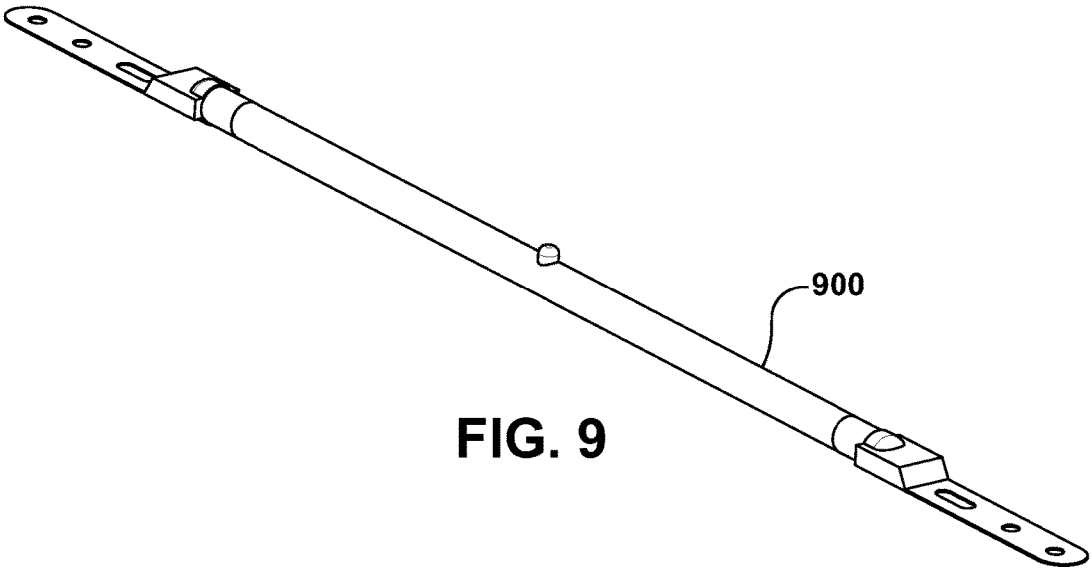
FIG. 9 is an example embodiment of a roller heater.

FIG. 9 illustrates an example embodiment of a roller heater 900, such as heating element 806 of FIG. 8. In this example, the roller heater 900 is comprised of an infrared halogen heater lamp, suitably a 1,000 Watt (1,000 Joules/second) lamp, which provides sufficient heating and cooling properties for controlled roller heating.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the spirit and scope of the inventions.

What is claimed is:

1. A saddle folder comprising:

a first set of heated rollers having parallel axes and configured to form a nip section therebetween;

the nip section configured receive paper at a central crease thereof;

a first motor drive configured to cooperatively rotate the first set of heated rollers to move received paper through the first set of heated rollers to form a paper fold at the central crease;

a controller configured to control operation of the first motor drive;

a second set of heated rollers having parallel axes, wherein the axes of the first set of rollers are substantially perpendicular to the axes of the second set of rollers, and wherein the second set of rollers is positioned so as to contact the paper fold therebetween after exiting the nip section; and a second motor drive configured to move the second set of rollers along the paper fold, wherein the controller is further configured to control operation of the second motor drive.

2. The saddle folder of claim 1 wherein the controller is further configured to stop the first motor drive when the paper is moved a preset distance relative to the second set of rollers, and operate the second motor drive when the paper is disposed at the preset distance.

3. The saddle folder of claim 2 wherein the controller is further configured to initiate a biasing force against the paper fold by the second set of rollers when the paper is located at the preset distance.

4. The saddle folder of claim 3 wherein the controller is further configured to release the biasing force after a preselected duration.

5. The saddle folder of claim 4 wherein the preselected duration is selected in accordance with a number of pages which comprise the received paper.

6. The saddle folder of claim 1 wherein the controller is further configured to enable operation of the second motor drive when the paper includes multiple pages in excess of a predefined page threshold.

7. The saddle folder of claim 1 wherein the controller is further configured to engage a heater element associated with the first set of heated rollers prior to receipt of paper at the nip section and to disengage the heater element when the paper fold passes an exit nip section of the first set of rollers.

8. A method comprising:

receiving paper, at a central crease thereof, into a nip formed by a first set of aligned heated rollers having parallel axes;

cooperatively rotating the first set of heated rollers to move received paper through the first set of heated rollers to form a paper fold at the central crease;

receiving the paper into a second set of heated rollers having parallel axes, wherein the axes of the first set of rollers are substantially perpendicular to the axes of the second set of rollers, and wherein the second set of rollers is positioned so as to contact the paper fold therebetween after exiting the nip section; and moving the second set of rollers along the fold.

9. The method of claim 8 further comprising:

stopping the first motor drive when the paper is moved a preset distance relative to the second set of rollers; and operating the second motor drive when the paper is disposed at the preset distance.

10. The method of claim 9 further comprising initiating a biasing force against the paper fold by the second set of rollers when the paper is located at the preset distance.

11. The method of claim 10 further comprising releasing the biasing force after a preselected duration.

12. The method of claim 11 further comprising selecting the preselected duration in accordance with a number of pages which comprise the received paper.

13. The method of claim 8 further comprising enabling operation of the second motor drive when the paper includes multiple pages in excess of a predefined page threshold.

14. The method of claim 8 further comprising engaging a heater element associated with the first set of heated rollers prior to receipt of paper at the nip section and disengaging the heater element when the paper fold passes an exit nip section of the first set of rollers.

15. A system comprising:

a first set of heated rollers having parallel axes and configured to form a nip section therebetween, the nip section configured receive paper at a central crease thereof;

a first motor drive configured to cooperatively rotate the first set of heated rollers to move received paper through the first set of heated rollers to form a paper fold at the central crease;

a second set of rollers having parallel axes, wherein the axes of the first set of rollers are substantially perpendicular to the axes of the second set of rollers, and wherein the second set of rollers is positioned so as to contact the paper fold therebetween after exiting the nip section;

a second motor drive configured move the second set of rollers along the paper fold; and a controller configured to control operation of the first motor drive, control operation of the second motor drive, pause the first motor drive for a selected duration when the paper is moved a preset distance relative to the second set of rollers, operate the second motor drive during the selected duration when the paper is disposed at the preset distance, and engage a heater element associated with one or more of the first set of heated rollers and the second set of rollers.

16. The system of claim 15 wherein the controller is further configured to initiate a biasing force against the paper fold by the second set of rollers when the paper is located at the preset distance.

17. The system of claim 15 wherein a heater element is associated with the second set of rollers, and wherein the controller is further configured to control one or more of a level of the biasing force, a temperature of the second set of rollers and the selected duration in accordance with a number of paper sheets comprising the received paper.

18. The system of claim 15 wherein a heater element is associated with the first set of rollers, and wherein the controller is further configured to disengage that heating element after the paper fold passes an exit nip section of the first set of heated rollers.

* * * * *